US006012238A

United States Patent [19]

McKenzie et al.

[11] Patent Number: 6,012,238

[45] Date of Patent: Jan. 11, 2000

[54] SNOWSHOE HEEL LIFT AND COMBINATION

[75] Inventors: Melissa McKenzie; George Neidhardt, both of Sacramento, Calif.

[73] Assignee: Pride Industries, Inc., Sacramento, Calif.

[21] Appl. No.: 09/046,807

[22] Filed: Mar. 23, 1998

[51] Int. Cl.[7] ..... A43B 5/04

[52] U.S. Cl. ..... 36/125; 36/122

[58] Field of Search ..... 36/122, 123, 124, 36/125

[56] References Cited

U.S. PATENT DOCUMENTS

| | | | |
|---|---|---|---|
| 2,154,019 | 4/1939 | Westphal | 280/600 |
| 4,620,375 | 11/1986 | Wallace | 36/125 |
| 4,720,927 | 1/1988 | Abegg | 36/122 |
| 5,857,272 | 1/1999 | Gallay et al. | 36/122 |

FOREIGN PATENT DOCUMENTS

| | | | |
|---|---|---|---|
| 1235782 | 6/1986 | Switzerland | 36/122 |

OTHER PUBLICATIONS

Redfeather, Inc. Promotional Literature showing "snap–on" heel lift.

Black Diamond, Ltd., "Televates" Instructional Literature showing cross country bail–type lift.

SK'ALP literature showing cross country bail–type lift and binding.

*Primary Examiner*—M. D. Patterson
*Attorney, Agent, or Firm*—John P. Costello

[57] ABSTRACT

A snowshoe heel lift for preventing heel strain and fatigue is disclosed. The snowshoe heel lift described herein is comprised of a substantially planar heel platform and a bail member coupled thereto. The bail member articulates between a deployed and a retracted position. When in the deployed condition, the bail member abuts against an external support which is coupled to the heel platform. The external support keeps the bail member deployed and the bail member and external support are together capable of supporting the weight of a snowshoer, without collapsing. A heel lift and snowshoe combination is also disclosed.

3 Claims, 4 Drawing Sheets

SNOWSHOE HEEL LIFT AND COMBINATION

BACKGROUND OF THE INVENTION

1. Field of the Invention

This invention pertains to snowshoeing and, more specifically, to a heel lift device for combining with a snowshoe for purposes of preventing heel strain during steep climbs on snowshoe treks.

2. Description of the Background Art

Snowshoeing has grown in popularity in recent years. This pleasant winter sport offers the solitude of cross country skiing without the investment in time required to learn how to maneuver on awkward skis. Everyone can walk, and hence, anyone who can walk, can snowshoe. Additionally, snowshoe enthusiasts can practice their sport wherever there is snow and therefore they are not confined to snowshoeing at expensive ski resorts. This simple, aerobic sport therefore appeals to a wide range of outdoor enthusiasts Snowshoeing is generally very comfortable and easy to do. However, without fail, snowshoers almost always encounter steep inclines during their treks, at which time they must lean forward into the incline and expend energy in making it to the top. During this phase, the snowshoer's heel and Achilles tendon extend a greater distance than during travel on flat surfaces. This greater extension can lead to overextension of the heel and Achilles tendon, which can result in pain and fatigue over time.

A solution to this overextension problem has been to incorporate heel lifts into snowshoes to elevate the heel, a substantial distance, for purposes of preventing overextension. For example, Redfeather, Inc. has incorporated a "snap-on" heel lift comprised of a raised solid member which snaps into a receptacle mounted on the snowshoe decking. Upon reaching flat terrain, the snowshoe user unsnaps this device from the receptacle. This device is nonadjustable, thereby limiting its use with different boot and heel sizes. Also, this device requires the solid member to be stored separately from the snowshoe, when not in use, thereby leading to the possibility of loss by the snowshoe user.

A second type of heel lift is that seen in cross country ski gear, which employs a metallic "bail", which can be deployed into a raised position for uphill climbing, and subsequently lowered, for travel over flat terrain. The advantage of the bail-type heel lift is that it remains attached to the ski, in one piece, and therefore, there are no separate parts to lose. Examples of bail-type cross country ski heel lifts are seen in bindings made by Alpine Trekker; Tele-Vates™ made by Black Diamond, Inc.; and the model 8007 binding made by SK'ALP, Inc.

The cross country ski bail-type heel lifts are designed with an internal mechanism for holding the bail in place against the hard surface of the cross country ski. This design has proven to be reliable and capable of supporting the weight of an adult or child cross-country skier. However, a drawback occurs when this design is placed upon the flexible decking of a snowshoe, as when weight is placed upon this design, the bail collapses, and fails to hold the weight of a normal adult or child. The cause of the problem appears to be the flexible snowshoe decking which fails to hold the bail tightly in place, which is not a problem when the bail is held against the hard surface of a cross country ski.

Additionally, snowshoe users require a heel lift to be adjustable for differently sized boots and heels. The Redfeather snowshoe lift described above is not adjustable. The bail-type cross country heel lifts are also not capable of adjustment, as the bail typically remains in a single position when it is deployed.

Accordingly, the foregoing information reflects the state of the art of which the inventor is aware, and is tendered with a view toward discharging the inventor's acknowledged duty of candor in disclosing information which may be pertinent with regards to the patentability of the present invention. It is respectfully stipulated, however, that the disclosed information does not teach or render obvious, singly or when considered in combination, the inventor's claimed invention.

SUMMARY OF THE INVENTION

By way of example, and not of limitation, a first aspect to the present invention generally pertains to an adjustable bail-type snowshoe heel lift. This heel lift can be coupled to the flexible decking of a snowshoe and will support the weight of an adult snowshoer, without collapsing, during normal usage. The invention is comprised of a bail member which is coupled to a heel platform, the heel platform serving both as a means for positioning the bail member and as a plate for resting the snowshoer's heel when the bail member is not deployed. The bail member can be moved to accommodate different boot and heel sizes by loosening the heel platform from the snowshoe decking and moving the bail member to different adjustment positions located up and down the heel platform. Upon reaching an incline, the snowshoer can deploy the bail member into its raised position. Upon reaching flat terrain, the user can lower the bail member, to a retracted position, slightly below the level of the platform, so that it does not interfere with the snowshoer's progress over flat terrain.

A second, third and fourth embodiment of the snowshoe heel lift are presented herein which, like the first embodiment, combine the desirable features of an adjustable bail member which resists collapsing upon a snowshoe decking.

When the various embodiments of this invention are combined with a snowshoe, the previous drawbacks relating to cross country heel lifts are effectively solved, and the snowshoer enjoys a reliable heel lift which significantly reduces heel fatigue.

Accordingly, this invention will be more fully understood through the following objects and advantages:

It is an object of this invention to have a bail-type heel lift for use on snowshoes It is another object of this invention to have a bail-type heel lift for snowshoes that is adjustable for different boot and heel sizes.

It is another object of this invention to have a bail-type heel lift and snowshoe combination.

It is another object of this invention to have a snowshoe heel lift which is not susceptible to loss by the snowshoer.

It is another object of this invention to have a snowshoe heel lift which can be easily deployed and retracted by the snowshoer.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, the present invention is a bail-type heel lift 10 for snowshoes 12. This heel lift resists collapsing under the weight of an adult snowshoer during normal use. Furthermore, heel lift 10 incorporates an adjustable bail member 14 which allows it to be used with different sized boots and heels.

Figure 1:
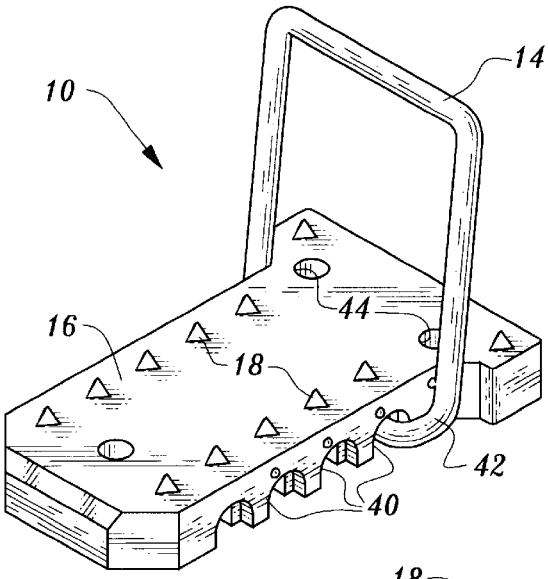
FIG. 1 is an elevated perspective view of the first embodiment of the snowshoe heel lift which is the present invention showing the bail member in a deployed condition.
Figure 2:
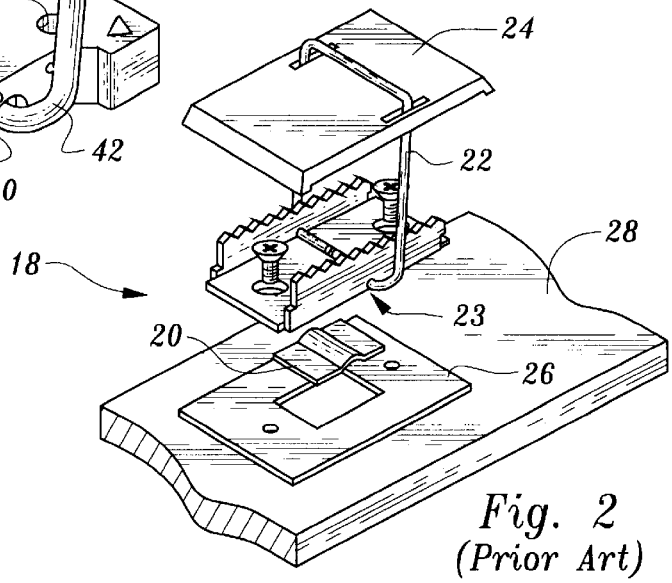
Fig. 2 (Prior Art)
FIG. 2 is an exploded view of a prior-art "internalized" heel lift used with cross country skis.

Referring to FIG. 1, the first embodiment of the snowshoe heel lift 10 is shown illustrating bail member 14, heel platform 16, and projections 18 which serve as a gripping surface upon the substantially planar top surface of heel platform 16 to prevent a snowshoer's heel from slipping off heel platform 16. FIG. 2 illustrates the prior art cross country ski heel lift 18 which has been proven unable to perform adequately upon the flexible decking of a snowshoe 12. The cross country ski design is an "internalized" design with five components, including an internal spring 20, bail member 22, bail member retainer 23, bail member cover 24, and base plate 26. This design works well upon the hard surface of a cross country ski 28 and does not collapse under normal use. However, when placed upon the flexible decking of a snowshoe the bail member 22 of this cross-country design tends to collapse when the weight of a snowshoer is applied.

Figure 3:
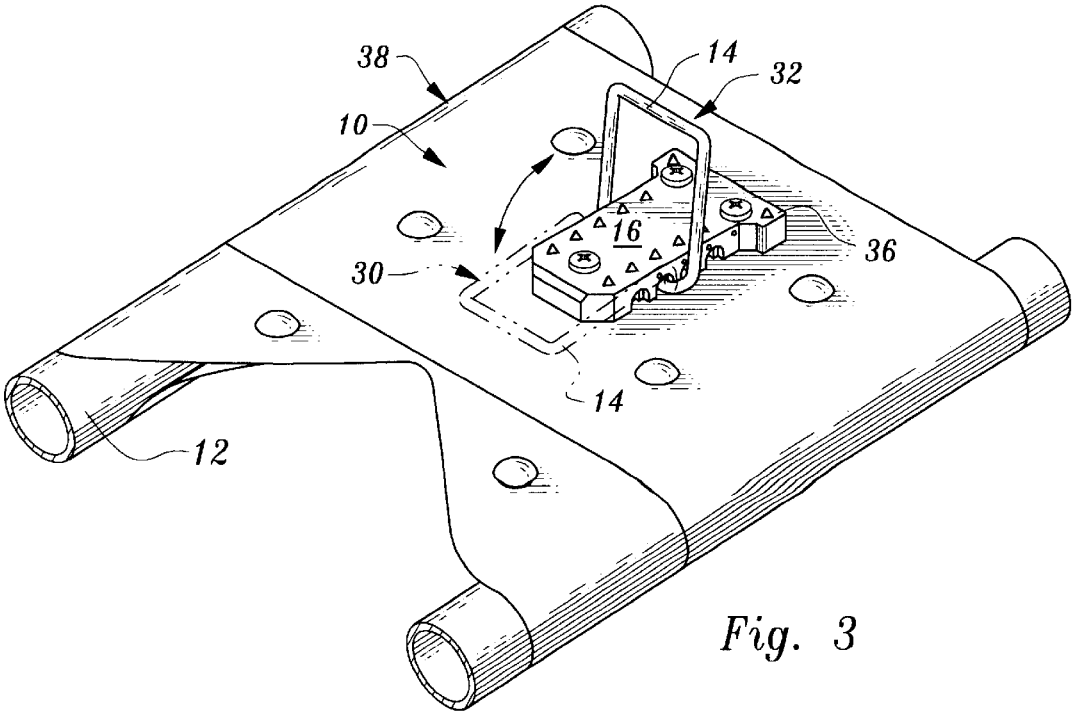
FIG. 3 is an elevated perspective view of the first embodiment of the snowshoe heel lift, coupled to a snowshoe, and showing the bail member alternating between deployed and retracted positions.
Figure 4:
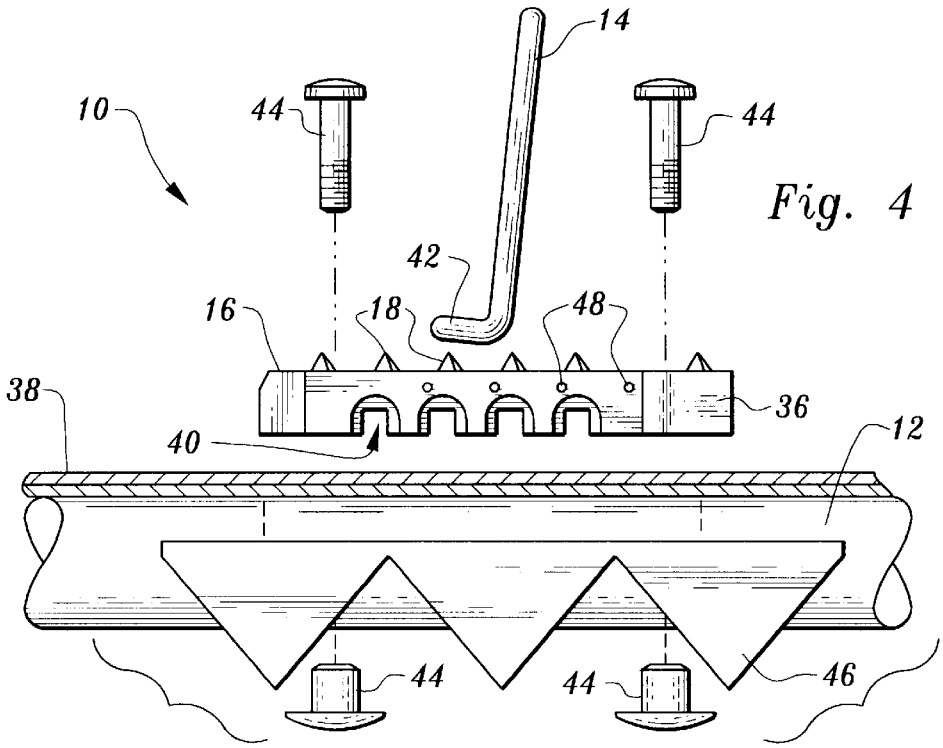
FIG. 4 is an exploded side view of the heel lift and snowshoe which is the present invention.
Figure 5:
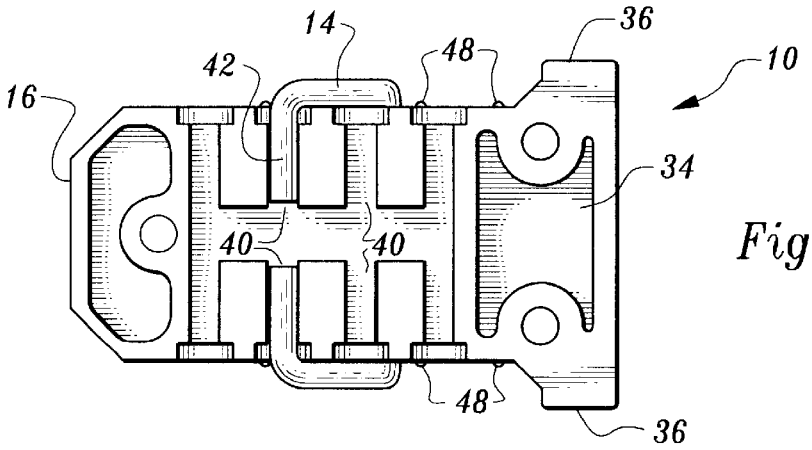
FIG. 5 is a bottom view of the first embodiment of the snowshoe heel lift.

FIG. 3 shows the first embodiment alternating the rotatable bail member 14 between a retracted 30 position and a deployed position 32. FIG. 4 shows an exploded view of the first embodiment of the heel lift 10 placed upon a cutaway section of a snowshoe 12. FIG. 5 shows the underside 34 of the first embodiment of heel lift 10.

As can be seen in FIGS. 3–5, the heel lift 10 of the present invention comprises an external support means 36 for abutting bail member 14 against, while in the deployed position. Support means 36 supports bail member 14 when the weight of a snowshoer is applied, thereby preventing bail member 14 from collapsing. This design has proven to be highly reliable and resistant to collapsing upon the flexible decking 38 of a snowshoe 12. A plurality of cavities 40 imparted into the side of heel platform 16 provides a receptacle for the placement of legs 42 of bail member 14. Coupling means 44, such as screws, couple heel platform 16 to a snowcleat 46, or similar platelike member of snowshoe 12. In this way, legs 42 are "sandwiched" between heel platform 16, snowshoe decking 38 and snowcleat 46. However, the pressure exerted upon legs 42 by this design still allows them to be fully rotatable for deploying and retracting bail member 14.

Figure 6:
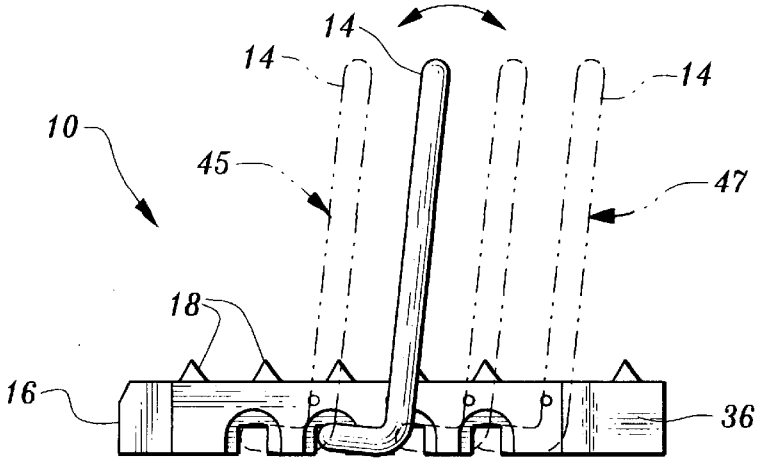
FIG. 6 is a side view of the first embodiment of the snowshoe heel lift with the bail member being placed at different positionings, some of the positionings being illustrated in phantom.

Referring to FIG. 6, the variety of positionings of bail member 14 for a four-position heel platform 16 is shown. The positionings are illustrated by the bail member 14, shown sometimes in phantom, varying from shortest 45 to longest 47 length. To achieve the four positionings shown, coupling means 44 must be unloosened from heel platform 16 enough to allow legs 42 of bail member 14 to travel between cavities 40. Once a desired cavity 40 is reached, heel platform 16 is tightened back in place with coupling means 44. In all positions, bail member 14 rests solidly against support means 36. By alternating between shortest 45 to longest 47 positioning, heel lift device 10 can be adapted for different heel designs and shoe sizes, thereby reaching a positioning that is most comfortable to the snowshoer. A plurality of detentes 48 located along the sides of heel platform 16 provide a means for designating the engagement of bail member 14. As bail member 14 brushes past each detente 48, a "clicking" sound is made, thereby signaling to the snowshoer, that the bail member is in motion and about to be fully engaged against support means 36.

Figure 7B:
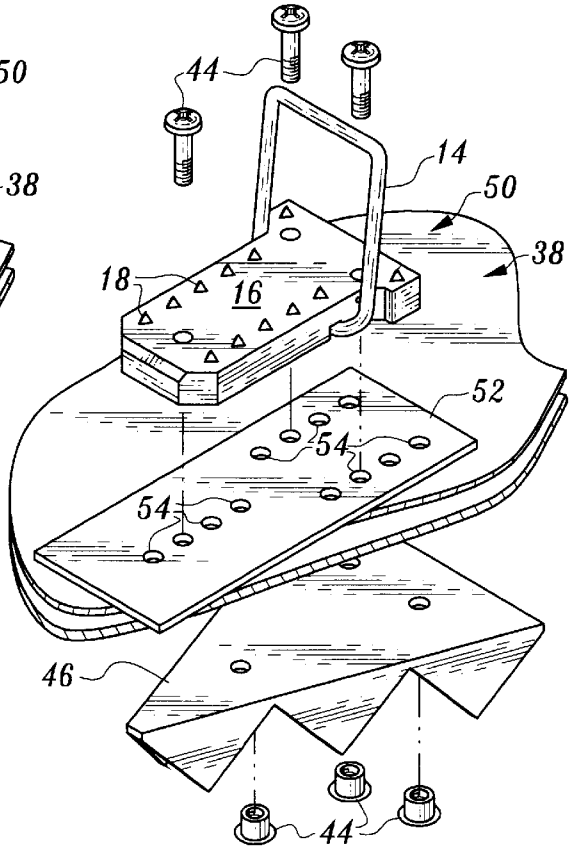
FIG. 7*b* is an exploded perspective view of the embodiment shown in FIG. 7*a* showing the heel platform moved to a second position upon the snowshoe decking.
Figure 7A:
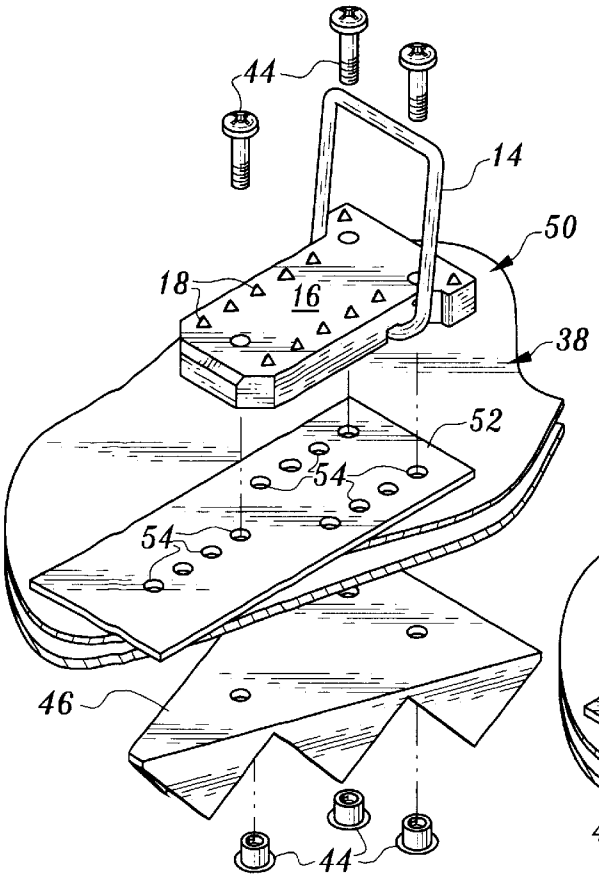
FIG. 7*a* is an exploded perspective view of a second embodiment of the heel lift showing the heel platform being placed at a first position upon a snowshoe decking.

FIGS. 7 *a–b* illustrate a second embodiment 50 of the bail-type snowshoe heel lift. In this embodiment, bail member 14 is rotatable but remains in the same position upon heel platform 16. Heel platform 16 engages with a stationary member 52 attached to snowshoe decking 38 and snow cleat 46. Adjustability is achieved by moving heel platform 16 up and down stationary member 52 and engaging it in place at a selected position 54. The bail operates as previously described by alternating between deployed and retracted positions.

Figure 8:
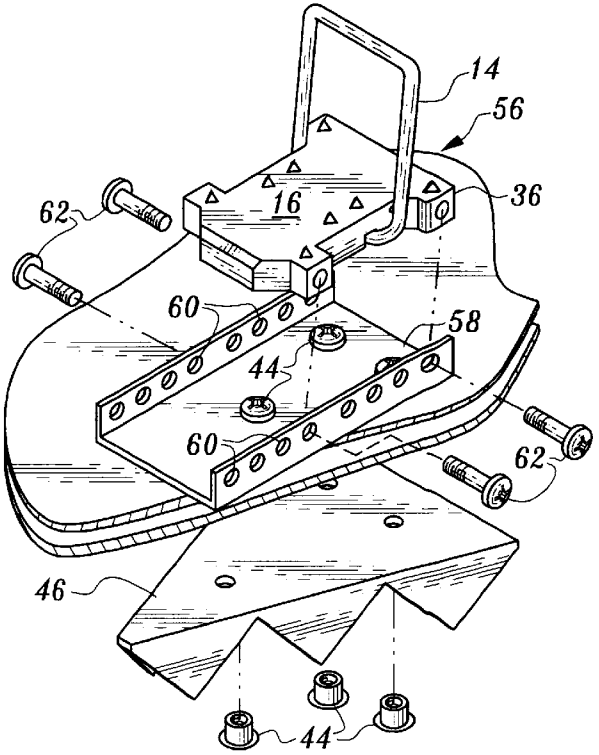
FIG. 8 is an exploded perspective view of a third embodiment of the heel lift showing the heel platform being selectively positionable within a tray receptacle.

FIG. 8 represents a third embodiment 56 of this invention. Here, bail member 14 is attached to heel platform 16, wherein heel platform 16 is selectively coupled to a tray member 58 at various positions 60 using fastening means 62. Heel platform 16 slides within tray member 58 until a desired position 60 is reached, at which time fastening means 62 fastenably engage heel platform into place.

Figure 9A:
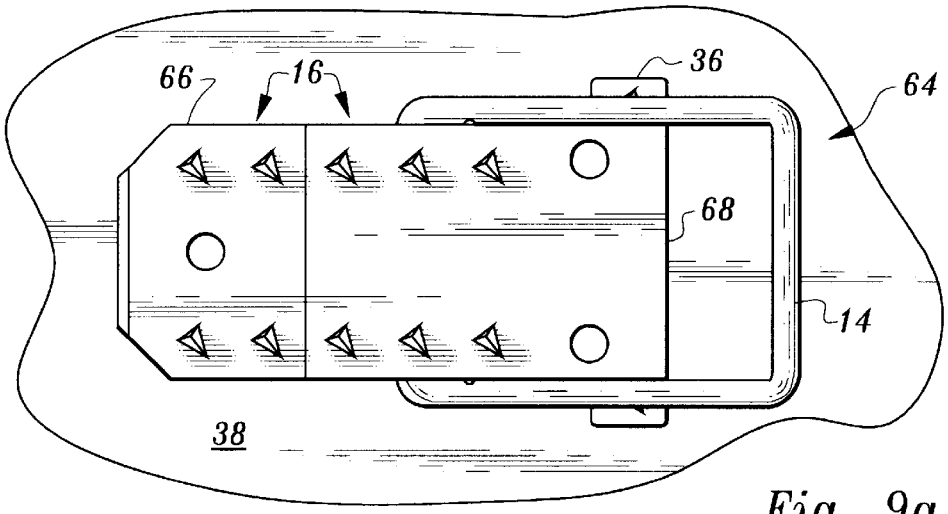
FIG. 9*a* is a plan view of a fourth embodiment of the heel lift showing the heel platform comprised of front and rear members wherein the rear member telescopes in relation to the front member.
Figure 9B:
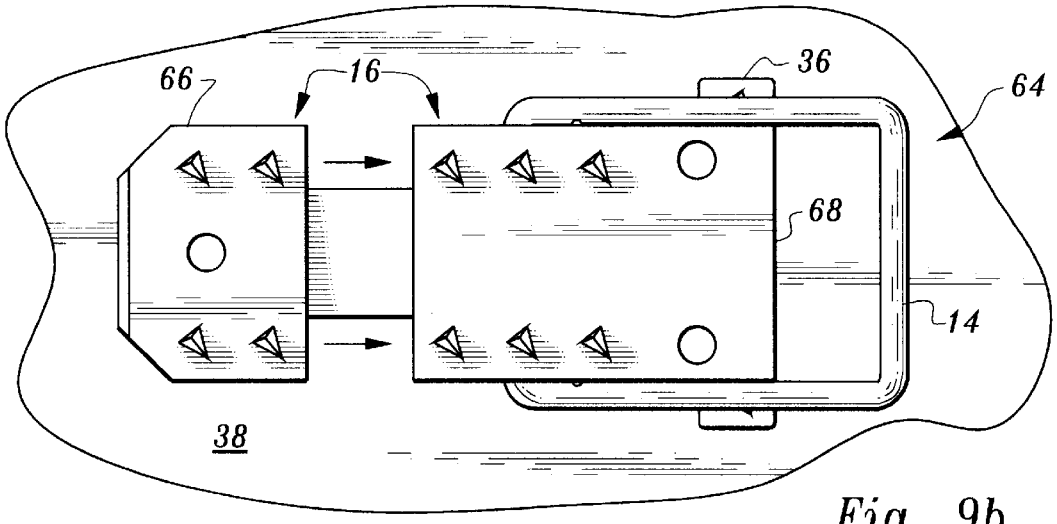
FIG. 9*b* is a plan view of the embodiment shown in FIG. 9*a* showing the rear member telescoping in relation to the front member.

FIGS. 9*a–b* illustrates a fourth embodiment 64 of this invention. Here, bail member 14 is attached to heel platform 16 which is comprised of first 66 and second 68 members, wherein second member 68 containing bail member 14 and support means 36 telescopes in relation to first member 66. In this manner, bail member 14 is made adjustable between different positionings. First member 66 remains stationarily fastened to snowshoe decking 38, while second member 68 and bail member 14 can be telescoped to different positionings.

Figure 10:
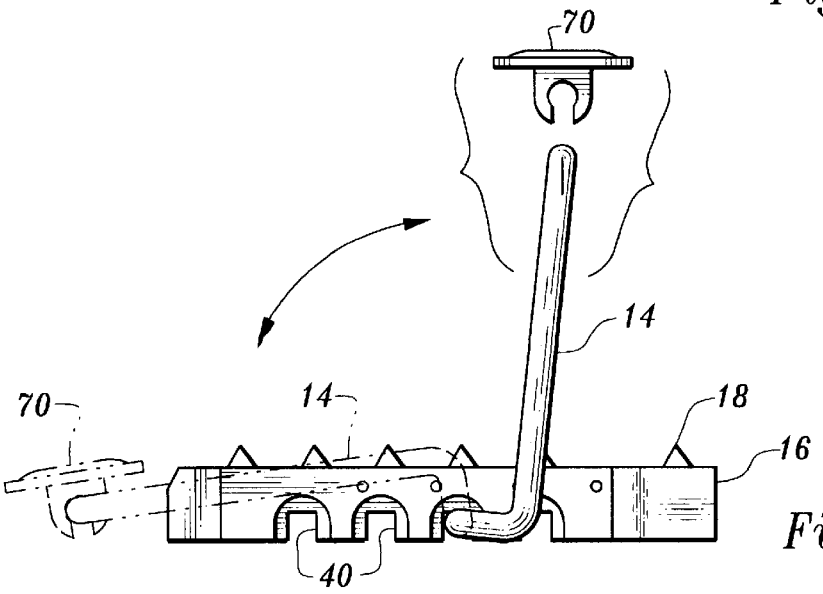
FIG. 10 is a side view of the preferred first embodiment, shown with a heel platform coupled to the bail member.

FIG. 10 illustrates a platform 70 which is attachable to bail member 14, platform 70 for creating more surface area for heel placement. When retracted, platform 60 swivels outward to lay flat against snowshoe decking 38, as shown.

This invention is also a bail-type heel lift and snowshoe combination. A bail-type heel lift having the characteristics of the previously described embodiments combined with a snowshoe has not been practical until now. The externalized design of the herein described embodiments allow for a bail-type heel lift to be used with a snowshoe without collapsing under the weight of a snowshoer.

Finally, although the description above contains many specificities, these should not be construed as limiting the scope of the invention, but as merely providing illustrations of some of the presently preferred embodiments of this invention. Thus the scope of this invention should be determined by the appended claims and their legal equivalents.

I claim:

1. A heel lift for a snowshoe having a flexible decking, said heel lift comprising:

a bail member for supporting the weight of a snowshoer, said bail member rotatably coupled to a heel platform, said bail member having legs for placing in a plurality of differently positioned cavities located in said heel platform, said bail member articulating between a retracted and a deployed condition for supporting a snowshoer, said heel platform coupled upon said snowshoe decking with coupling means, said bail member contacting an externalized support means continuous with said heel platform when in said deployed condition, said externalized support means for supporting said bail member without collapsing while under the weight of a snowshoer.

2. A heel lift for a snowshoe having a flexible decking the heel lift comprising:

a bail member for supporting the weight of a snowshoer, said bail member rotatably coupled to a heel platform having a substantially planar top surface for placing a heel, said planar top surface including a plurality of projections for gripping a heel, said bail member articulating between a retracted and a deployed condition while slidably engaging a plurality of detentes, said bail member having legs for placing in a plurality of differently positioned cavities located in said heel platform, said heel platform coupled to said decking with a coupling means, said bail member contacting an external support means continuous with said heel platform when in said deployed condition, said external support means for supporting said bail member and holding it in a deployed state without collapsing while under the weight of a snowshoer.

3. In combination:

a) a snowshoe, said snowshoe comprising a frame, a binding and a decking material spanning across and coupled to said frame; and b) a heel lift comprising a bail member for supporting the weight of a snowshoer, said bail member rotatably coupled to a heel platform, said bail member having legs for placing in a plurality of differently positioned cavities located in said heel platform, said bail member articulating between a retracted and a deployed condition for supporting a snowshoer, said heel platform coupled upon said snowshoe decking with coupling means, said bail member contacting a support means continuous with said heel platform when in said deployed condition, said support means for supporting said bail member without collapsing while under the weight of a snowshoer.

* * * * *